US009574758B2

(12) United States Patent
Ahn et al.

(10) Patent No.: US 9,574,758 B2
(45) Date of Patent: Feb. 21, 2017

(54) LIGHT-EMITTING DIODE LIGHTING APPARATUS HAVING MULTIFUNCTIONAL HEAT SINK FLANGE

(71) Applicants: In-Kyu Ahn, Gyeonggi-do (KR); Seul-Ki Lee, Gwangju (KR)

(72) Inventors: In-Kyu Ahn, Gyeonggi-do (KR); Seul-Ki Lee, Gwangju (KR)

( * ) Notice: Subject to any disclaimer, the term of this patent is extended or adjusted under 35 U.S.C. 154(b) by 59 days.

(21) Appl. No.: 14/210,579

(22) Filed: Mar. 14, 2014

(65) Prior Publication Data

US 2014/0347846 A1 Nov. 27, 2014

(30) Foreign Application Priority Data

May 22, 2013 (KR) ..... 10-2013-0057826

(51) Int. Cl.

| | |
|---|---|
| ***F21V 29/00*** | (2015.01) |
| ***F21S 8/00*** | (2006.01) |
| ***F21L 4/00*** | (2006.01) |
| ***F21S 8/08*** | (2006.01) |
| ***F21V 29/85*** | (2015.01) |

(Continued)

(52) U.S. Cl.

CPC ..... *F21V 29/24* (2013.01); *F21S 8/036* (2013.01); *F21S 8/08* (2013.01); *F21V 29/85* (2015.01); *F21S 8/063* (2013.01); *F21V 5/06* (2013.01); *F21V 15/02* (2013.01); *F21V 17/12* (2013.01); *F21V 29/20* (2013.01); *F21V 29/713* (2015.01); *F21V 29/773* (2015.01); *F21V 29/87* (2015.01); *F21V 29/89* (2015.01)

(58) Field of Classification Search

CPC ..... F21V 29/24; F21V 29/70; F21V 29/76; F21V 29/85; F21V 29/713; F21V 5/06; F21V 17/12; F21S 8/036; F21S 8/08

See application file for complete search history.

(56) References Cited

U.S. PATENT DOCUMENTS 1,777,824 A * 10/1930 Blitzer ..... F21S 6/005 362/307
3,112,894 A * 12/1963 Pearlman ..... F21V 17/04 362/294

(Continued)

FOREIGN PATENT DOCUMENTS

JP 05-002311 U 1/1993
JP 2010-049830 A 3/2010

(Continued)

*Primary Examiner* — Renee Chavez
*Assistant Examiner* — Colin Cattanach
(74) *Attorney, Agent, or Firm* — Rabin & Berdo, P.C.

(57) ABSTRACT

Disclosed is a light-emitting diode (LED) lighting apparatus having a multifunctional heat sink flange, which includes an LED board on which a transmitted light cap and a plurality of LEDs are mounted, a main heat sink formed of magnesium or an magnesium alloy, an auxiliary heat sink formed of a conductive/polymeric resin material for heat dissipation, a heat sink upper case formed of a conductive/polymeric resin material for heat dissipation, and a power supply. The main heat sink includes multiple streamlined heat sink segments that are integrally formed on an outer surface thereof so as to radially protrude to allow air to flow in all directions, and a heat sink flange formed along an outer circumference of a bottom thereof such that omega-shaped wings having enclosed holes and inverse omega-shaped open holes are alternately formed.

10 Claims, 8 Drawing Sheets

(51) Int. Cl.

| | |
|---|---|
| *F21S 8/06* | (2006.01) |
| *F21V 5/06* | (2006.01) |
| *F21V 15/02* | (2006.01) |
| *F21V 17/12* | (2006.01) |
| *F21V 29/71* | (2015.01) |
| *F21V 29/77* | (2015.01) |
| *F21V 29/87* | (2015.01) |
| *F21V 29/89* | (2015.01) |

(56) References Cited

U.S. PATENT DOCUMENTS

| | | | | |
|---|---|---|---|---|
| 4,091,444 | A * | 5/1978 | Mori | F21V 17/107 362/164 |
| 5,116,009 | A * | 5/1992 | Bayer | F21V 5/06 248/303 |
| 5,384,694 | A * | 1/1995 | Yang | F21S 8/081 362/298 |
| 6,206,546 | B1 * | 3/2001 | Krogman | F21V 17/12 362/267 |
| 7,261,444 | B2 * | 8/2007 | Bayer | F21V 5/06 362/147 |
| 7,670,029 | B1 * | 3/2010 | Luo | F21V 15/02 362/249.06 |
| 2004/0057237 | A1 * | 3/2004 | Cutting | F21S 8/033 362/307 |
| 2006/0157207 | A1 * | 7/2006 | Schonbek | F21S 8/065 160/332 |
| 2009/0040774 | A1 * | 2/2009 | Avila | F21V 21/28 362/371 |
| 2010/0039831 | A1 * | 2/2010 | Liu | F21S 48/1159 362/547 |
| 2010/0060130 | A1 * | 3/2010 | Li | F21V 29/004 313/46 |
| 2010/0103669 | A1 * | 4/2010 | Yang | F21V 5/04 362/234 |
| 2010/0110699 | A1 * | 5/2010 | Chou | F21S 8/026 362/365 |
| 2010/0171403 | A1 * | 7/2010 | Yang | F21K 9/00 313/46 |
| 2010/0184321 | A1 * | 7/2010 | Zhou | F21V 19/04 439/345 |
| 2010/0208473 | A1 * | 8/2010 | Sakai | F21S 8/04 362/373 |
| 2010/0246194 | A1 * | 9/2010 | Nankil | F21S 2/00 362/368 |
| 2011/0309403 | A1 * | 12/2011 | Kawashima | F21V 31/00 257/99 |
| 2012/0080992 | A1 * | 4/2012 | Huang | F21K 9/13 313/46 |
| 2012/0087118 | A1 * | 4/2012 | Bailey | F21V 29/75 362/235 |
| 2012/0195041 | A1 * | 8/2012 | Fletcher | F21V 29/773 362/249.02 |
| 2012/0218768 | A1 * | 8/2012 | Hisano | F21K 9/135 362/363 |
| 2013/0128578 | A1 * | 5/2013 | Yu | F21S 8/04 362/244 |
| 2014/0084787 | A1 * | 3/2014 | Tsai | F21K 9/13 315/50 |
| 2014/0085906 | A1 * | 3/2014 | Keogan | F21S 8/02 362/355 |

FOREIGN PATENT DOCUMENTS

| | | | |
|---|---|---|---|
| JP | 2010-170696 | A | 8/2010 |
| JP | 2013-065436 | A | 4/2013 |
| KR | 20-0211071 | Y1 | 2/2001 |
| KR | 10-0969167 | B1 | 7/2010 |
| KR | 20-0451488 | Y1 | 12/2010 |
| KR | 10-1032415 | B1 | 5/2011 |
| KR | 10-2011-0118745 | A | 11/2011 |
| KR | 10-1095868 | B1 | 12/2011 |
| KR | 10-1322614 | B1 | 10/2013 |
| WO | WO 2009/157370 | A1 | 12/2009 |

* cited by examiner

LIGHT-EMITTING DIODE LIGHTING APPARATUS HAVING MULTIFUNCTIONAL HEAT SINK FLANGE

BACKGROUND OF THE INVENTION

Field of the Invention

The present invention relates, in general, to a light-emitting diode (LED) lighting apparatus having a multifunctional heat sink flange, and, more particularly, to an LED lighting apparatus having an electric lamp type device or a modular type device, in which: a heat sink flange is further formed along an outer circumference of the bottom of a main heat sink to which a LED board is directly fixed such that omega-shaped wings having enclosed holes and approximately inverse omega-shaped open holes are alternately formed as means for widening a heat dissipation area of the main heat sink; heat sink segments formed in various shapes such as a rod shape and a heat sink ring separately formed in various shapes such as a cylindrical shape can be removably installed in correspondence with a change in amount of heat generated from the LEDs installed on the LED board; and various structures (e.g., when the LED lighting apparatus is used as an explosion proof lamp, ornaments including a protective cage; an anti-dropping gadget; lighting apparatus fixing bolts; a lighting color presentation plate; a shock damage-proof cap; a post; or a reflector shade having various shapes) can be installed and used at need in correspondence with a place or a position at which the LED lighting apparatus is installed and a function of the LED lighting apparatus.

Description of the Related Art

Conventionally, lighting lamps widely used in common houses or offices include incandescent or fluorescent electric lamps. Such incandescent or fluorescent electric lamps have high power consumption, waste resources, obstruct environmental protection, and increase an environmental temperature to negatively influence the lamp's service time due to the easy generation of heat.

Thus, lamps using light-emitting diodes (LEDs) which are economical due to low power consumption and a possibility to be made small and are capable of maximizing a lighting effect due to various lighting rays and high visibility have been recently developed and used widely.

Here, LED refers to a photoelectric conversion semiconductor device having a structure in which n-type semiconductor crystals having electrons as majority carriers and p-type semiconductor crystals having holes as majority carriers are joined, and particularly a semiconductor light-emitting element using spontaneous emission light occurring when the electrons and holes injected into the p-n junction are recombined.

Due to high photoelectric conversion efficiency, the LED has very low power consumption and a resultant low generation of heat. Further, since the LED does not emit light based on thermal discharge, the LED does not require a preheating time, and thus are rapidly turned on or off.

Further, since the LED has neither a gas nor a filament, the LED resists a shock and is safe. Since the LED employs a stable direct current lighting-up mode, the LED has low power consumption, enables highly frequent pulse operation, is able to reduce visual fatigue, provides a semi-permanent service time, and is able to produce a lighting effect of various colors. As LED lighting lamps use a small light source, they can be made small.

However, the LED has a problem in that heat generated when an LED chip is driven exerts an influence on brightness and service time.

In a conventional design mainly used to overcome the problem with the generation of heat, a lamp case is formed of an aluminum alloy, and heat dissipation fins are integrally formed on an outer circumferential surface of the lamp case so as to improve a heat dissipation effect. However, the heat dissipation effect can be restrictively produced, which cannot be said to be preferable.

In detail, the conventional LED lighting lamps have a structure in which, when a case and heat dissipation fins are formed of an aluminum alloy, the aluminum alloy is pressed under high pressure using a die for die casting, and the heat dissipation fins formed to smoothly radiate heat generated when LEDs are driven are integrally formed on an outer circumferential surface of the case.

When a main body of the case integrated with the heat dissipation fins is formed using the die for die casting, the aluminum case main body and heat dissipation fins cannot be formed to be thin. As such, it is impossible to reduce weight of a product and to maximize a heat dissipation area. Further, the heat generated when the LEDs are driven cannot be effectively radiated. When the case is formed of the aluminum alloy using the die for die casting, electric wire holes and threaded holes should be formed by post processing. Productivity of products is reduced, and material expenses and production cost of the product are increased. Further, the heat dissipation fins are integrally formed at the same volume, and thus an internal space is reduced. As a result, it is very difficult to form a boss for detachably installing an upper cover or a transparent cap in the narrow space.

Thus, in some of recently proposed techniques, when the case of the LED lighting lamp is formed, a main body having a cylindrical shape is formed by extrusion, and multiple heat dissipation fins coupled to the main body and a disc-like cap to which the heat dissipation fins are radially coupled are formed by cutting and bending a thin steel sheet using a press. Thereby, the heat dissipation area of the heat dissipation fins that are fixedly installed on the main body is increased. In this case, the heat generated from the LEDs can be effectively radiated compared to the main body formed of aluminum.

However, in all the LED lighting lamps, the main body and the heat dissipation fins that are integrally formed or separately installed are formed of a metal. As such, there is a limitation in a reduction in weight. Further, when a short circuit occurs between a power supply for supplying power to the LEDs and the metallic main body, there is a possibility of electric shock.

Thus, to resolve this problem with insulation, in some cases, the power supply itself is formed in an expensive insulation type device. This leads to increasing a production cost of products. In other cases, a heat sink of the main body is covered with insulating paint. This also increases the production cost. Due to the insulating paint, the heat dissipation effect is significantly reduced.

To resolve the above problems, the applicant of the present invention has developed an "LED lighting module for improving heat dissipation and light efficiency," which is disclosed in Korean Unexamined Patent Application No. 10-2012-0087063.

The disclosed LED lighting module is a lighting module using LEDs having low heat generation, low power consumption, and high brightness as a light source. A heat sink for dissipating heat generated from the lighting module is injection-molded using a carbon nanotube metal polymer (CMP) that is a conductive/polymeric heat dissipation resin material containing carbon nanotubes (CNTs) having very excellent heat conductivity such that multiple streamlined heat dissipation rods provide a flow of air in all directions. If necessary, the heat sink is formed by insert injection molding such that an auxiliary heat dissipation plate formed of copper or aluminum having high heat conductivity is integrally formed on the bottom of the heat sink that is in direct contact with a LED board. Further, an upper case in which a power supply is installed is also formed of the CMP.

Thus, the LED lighting module can increase performance of dissipating heat generated from the power supply and the LEDs compared to a conventional lighting module, improve light efficiency of the LEDs, and reduce weight and size of a product itself and reduce production cost as well.

However, despite that the amount of generated heat is different depending on the number of LEDs installed on the LED board, the heat sink used for most of the conventional lighting modules including the lighting module having the aforementioned configuration and conventional lighting apparatuses is not provided with any structure capable of changing a critical capacity of dissipated heat according to the number of installed LEDs, i.e. does never provide changeability of the amount of generated heat with respect to different lighting capacities as well as compatibility of the heat sink itself. The lighting module and apparatus having various lighting capacities cannot be provided using the heat sink having the same shape and configuration.

Conventionally, the heat sinks having different shapes and configurations according to the respective lighting capacities and required capacity of dissipated heat should be separately formed, and multiple lighting modules and apparatuses having different lighting capacities and amounts of generated heat, the same external form, and different volumes should be manufactured. As such, the production cost of a product is increased.

Further, various lighting apparatuses manufactured using the LEDs are required to further install various structures according to an installed place or position or a use purpose, or to be coupled with another structure using such a structure. Among the conventional lighting apparatuses using the LEDs, some have a configuration allowed to be coupled with or installed on a specific structure only. However, no configuration capable of being selectively coupled with the structure regardless of the shape or purpose of the structure when used is provided.

DOCUMENTS OF RELATED ART (Patent Document 1) Korean Patent No. 10-1032415 (Apr. 25, 2011)

(Patent Document 2) Korean Registered Utility Model No. 20-0451488 (Dec. 13, 2010)

(Patent Document 3) Korean Unexamined Patent Application Publication No. 10-2011-0118745 (Nov. 1, 2011)

SUMMARY OF THE INVENTION

Accordingly, the present invention has been made keeping in mind the above problems occurring in the related art, and the present invention is intended to propose a light-emitting diode (LED) lighting apparatus having a multifunctional heat sink flange, in which, when the LED lighting apparatus is manufactured in an electric lamp type or in a modular type, the heat sink flange is further formed along an outer circumference of the bottom of a main heat sink to which a LED board is directly fixed such that omega-shaped wings having enclosed holes and approximately inverse omega-shaped open holes are alternately formed, thereby widening a heat dissipation area of the main heat sink having the same shape so that the multifunctional heat sink flange can not only further improve heat dissipation performance of the LED lighting apparatus but also remarkably improve light efficiency.

The present invention is also intended to propose a light-emitting diode (LED) lighting apparatus having a multifunctional heat sink flange, in which heat sink segments formed in various shapes such as a rod shape and a heat sink ring separately formed in various shapes such as a cylindrical shape can be removably installed on the heat sink flange that is integrally formed to protrude from the bottom of a main heat sink, and thereby an amount of dissipated heat (i.e. a heat dissipation area) of the main heat sink having the same shape can be arbitrarily changed in correspondence with a change in amount of heat generated from LEDs installed on an LED board in different numbers depending on different lighting capacities, making it possible to reduce the weight and a size of a product itself as well as to remarkably cut the production cost.

The present invention is also intended to propose a light-emitting diode (LED) lighting apparatus having a multifunctional heat sink flange, in which various structures (e.g., when the LED lighting apparatus is used as an explosion proof lamp, ornaments including a protective cage; an anti-dropping gadget; lighting apparatus fixing bolts; a lighting color presentation plate; a shock damage-proof cap; a post; or a reflector shade having various shape) can be installed and used in correspondence with a place or a position at which the LED lighting apparatus is installed and a function of the LED lighting apparatus using the heat sink flange integrally formed to protrude from the bottom of a main heat sink, and thereby it is possible to remarkably improve usability and compatibility of the LED lighting apparatus, and it is unnecessary to provide a separate component to be installed on the various structures so that the cost required to produce various lighting lamps using the LED lighting apparatus can be reduced.

In order to achieve the above objects, according to an aspect of the present invention, there is provided a light-emitting diode (LED) lighting apparatus having a multifunctional heat sink flange, which includes: an LED board on which a transmitted light cap and a plurality of LEDs are mounted; a main heat sink formed of magnesium or an magnesium alloy; an auxiliary heat sink formed of a conductive/polymeric resin material for heat dissipation; a heat sink upper case formed of a conductive/polymeric resin material for heat dissipation; and a power supply. The main heat sink includes multiple heat sink protrusions that are integrally formed on an outer surface thereof so as to radially protrude to allow air to flow in all directions, and a heat sink flange formed along an outer circumference of a bottom thereof such that omega-shaped wings having enclosed holes and inverse omega-shaped open holes are alternately formed. Thereby, the LED lighting apparatus functions as a low-powered lighting lamp when installed independently, and is used for other high-powered lighting lamps when combined and installed in a case having a predetermined area and shape so as to have a desired light output.

Here, the heat sink segments may be formed of aluminum or copper in a rod shape in order to variably increase a heat dissipation area, be disposed on upper surfaces of some of the wings of the heat sink flange that is integrally formed to protrude from the bottom of the main heat sink by a preset number, and be integrally fixed by riveting or bolts.

Further, the heat sink flange integrally formed to protrude from the bottom of the main heat sink may be removably coupled with a heat sink ring, which is formed of aluminum or copper to increase a heat dissipation area and is configured such that a cylinder having a predetermined height and diameter and a horizontal fixing plate are formed in one body, on an upper surface thereof.

Here, the heat sink ring may further include a plurality of ribs that function to reinforce strength and increase the heat dissipation area and that are disposed on an inner surface of the cylinder and on an upper surface of the horizontal fixing plate at predetermined intervals.

Further, the horizontal fixing plate of the heat sink ring may be formed in a shape opposite to that of the heat sink flange in such a manner that the omega-shaped open holes and the inverse omega-shaped wings having the enclosed holes are alternately repeated.

Also, the cylinder of the heat sink ring may have a plurality of vertical grooves and ridges that are alternately formed on each of inner and outer surfaces thereof in order to further increase the heat dissipation area.

Further, the bottom of the heat sink flange of the main heat sink may be removably coupled with a protective cage that encloses the transmitted light cap and that is fastened to the enclosed holes formed in the wings of the heat sink flange by a plurality of bolts.

Further, some of the inverse omega-shaped open holes formed between the wings of the heat sink flange of the main heat sink may be removably coupled with ornaments having a predetermined shape by ornament connecting chains.

Meanwhile, the LED lighting apparatus may further include an anti-dropping gadget that is removably installed between a lighting apparatus installing rod, which is fixed to a ceiling or a wall of a building so as to allow the LED lighting apparatus to be coupled in an electric lamp type, and one of the inverse omega-shaped open holes of the heat sink flange of the main heat sink.

Further, when installed in a ceiling embedded type, the LED lighting apparatus may be fixed to a ceiling by fastening the plurality of bolts to the enclosed holes of the wings formed in the heat sink flange of the main heat sink.

Further, the transmitted light cap removably installed on the bottom of the main heat sink may further include a colored pattern plate which is installed on an inner surface thereof and in which light transmitting portions are formed only on portions corresponding to positions of the LEDs.

Further, some of the wings of the heat sink flange of the main heat sink may be removably fixed to upper ends of a plurality of heat sink supports having a predetermined diameter and length by bolts, and the plurality of heat sink supports may be removably coupled with a lighting color presentation plate formed of a colored glass or plastic on lower ends thereof using the plurality of bolts.

Meanwhile, the LED lighting apparatus may further include a shock damage-proof plate that is removably installed under the transmitted light cap and is configured such that light passing holes are formed in a circular plate at portions at which the LEDs are located and such that a plurality of fixing pieces are bent on an outer circumference of the circular plate at a predetermined angle and are fixed to the enclosed holes of some of the wings of the heat sink flange of the main heat sink by bolts.

Further, the heat sink upper case in which the power supply is installed may be removably coupled with a quadrangular case, which has a spiral socket coupler or power cable guide holes on both sides thereof, on an upper portion thereof.

When the LED lighting apparatus is removably installed on a wall of a building in an electric lamp type in a horizontal direction, the plurality of wings of the heat sink flange of the main heat sink may be removably coupled with a upward domed light collecting reflector shade by a plurality of bolts so as to allow light irradiated from the LEDs to be reflected in a downward direction.

Further, when the LED lighting apparatus is removably installed on an upper end of a post installed on a terrace, the plurality of wings of the heat sink flange of the main heat sink may be coupled with lower ends of heat sink supports, each of which has a predetermined diameter and height, on upper surfaces thereof by a plurality of bolts, and the heat sink supports may be removably coupled with a downward domed light diffusing reflector shade on upper ends thereof so as to allow a part of light irradiated from the LEDs toward a ceiling or a sky to be reflected in a bottom direction of the terrace.

When a security light, a street light, or a floodlight is manufactured by installing a plurality of LED lighting apparatuses in the case having a predetermined area and shape so as to provide the desired light output, upper and lower ends of heat sink supports, each of which has a predetermined diameter and height, may be removably installed between upper surfaces of the plurality of wings of the heat sink flange of the main heat sink and a ceiling surface of the case using a plurality of bolts.

In addition, the heat sink supports may be formed of copper or aluminum.

According to the LED lighting apparatus having a multifunctional heat sink flange as described above, when the LED lighting apparatus is manufactured in an electric lamp type or in a modular type, the heat sink flange is further formed along an outer circumference of the bottom of a main heat sink to which a LED board is directly fixed such that omega-shaped wings having enclosed holes and approximately inverse omega-shaped open holes are alternately formed, thereby widening a heat dissipation area of the main heat sink having the same shape so that the multifunctional heat sink flange can not only further improve heat dissipation performance of the LED lighting apparatus but also remarkably improve light efficiency.

Further, heat sink segments formed in various shapes such as a rod shape and a heat sink ring separately formed in various shapes such as a cylindrical shape can be removably installed on the heat sink flange that is integrally formed to protrude from the bottom of a main heat sink, and thereby an amount of dissipated heat of the main heat sink having the same shape can be arbitrarily changed in correspondence with a change in amount of heat generated from LEDs installed on an LED board in different numbers depending on different lighting capacities, making it possible to reduce weight and a size of a product itself as well as to remarkably cut a production cost.

In addition, various structures (e.g., when the LED lighting apparatus is used as an explosion proof lamp, ornaments including a protective cage; an anti-dropping gadget; lighting apparatus fixing bolts; a lighting color presentation plate; a shock damage-proof cap; a post; or a reflector shade having various shape) can be installed and used in correspondence with a place or a position at which the LED lighting apparatus is installed and a function of the LED lighting apparatus using the heat sink flange integrally formed to protrude from the bottom of a main heat sink.

Thereby, it is possible to remarkably improve usability and compatibility of the LED lighting apparatus, and it is unnecessary to provide a separate component to be installed on the various structures so that a cost required to produce various lighting lamps using the LED lighting apparatus can be reduced.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to an exemplary embodiment of the invention with reference to the accompanying drawings.

Figure 1:
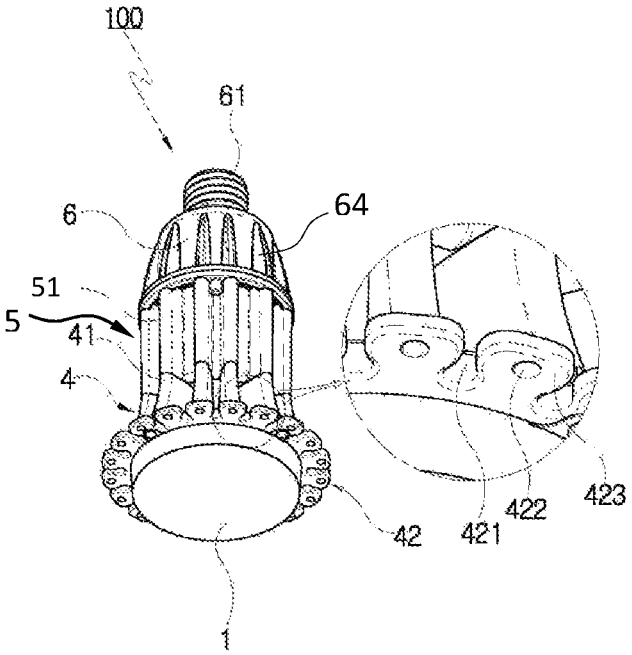
FIG. 1 is a perspective view showing a light-emitting diode (LED) lighting apparatus having a multifunctional heat sink flange according to the present invention.
Figure 2:
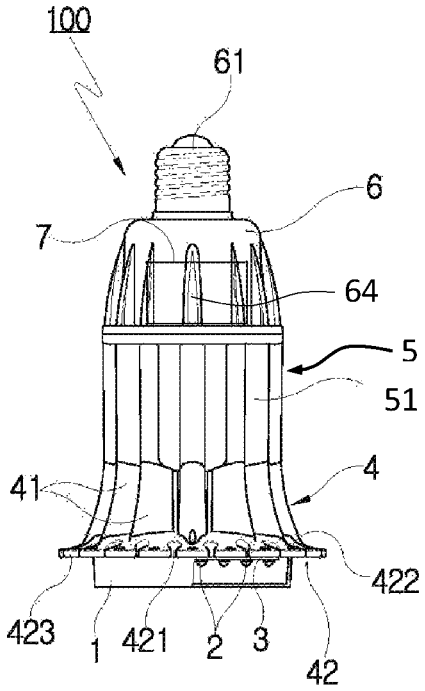
FIG. 2 is a partial cutaway front view showing the LED lighting apparatus having a multifunctional heat sink flange according to the present invention.
Figure 3:
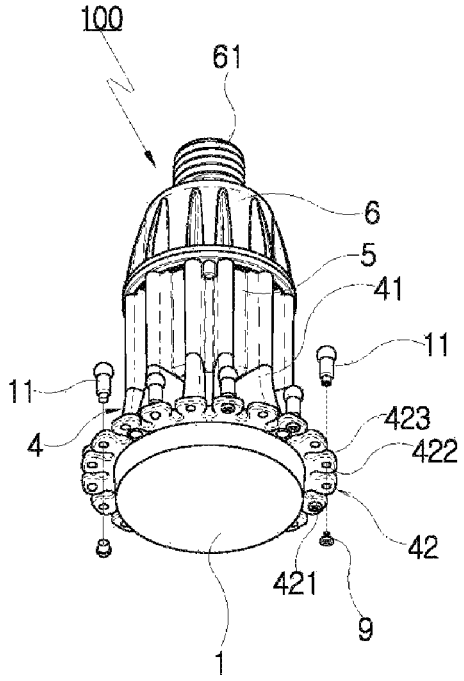
FIG. 3 is a partial exploded perspective view showing a state in which heat sink segments are further installed on the LED lighting apparatus having a multifunctional heat sink flange according to the present invention.
Figure 4:
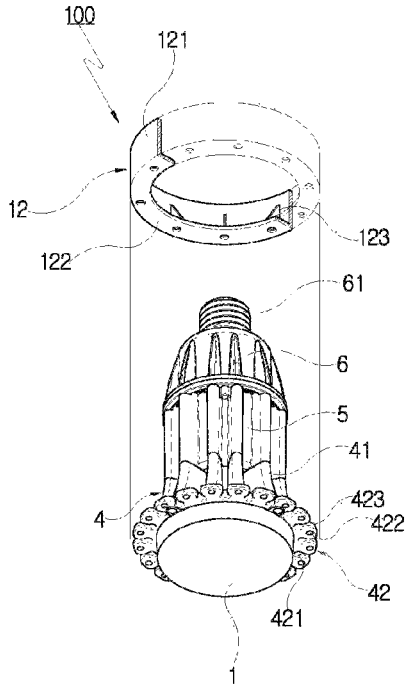
FIG. 4 is an exploded perspective view showing an embodiment of a heat sink ring applied to the LED lighting apparatus having a multifunctional heat sink flange according to the present invention.
Figure 5:
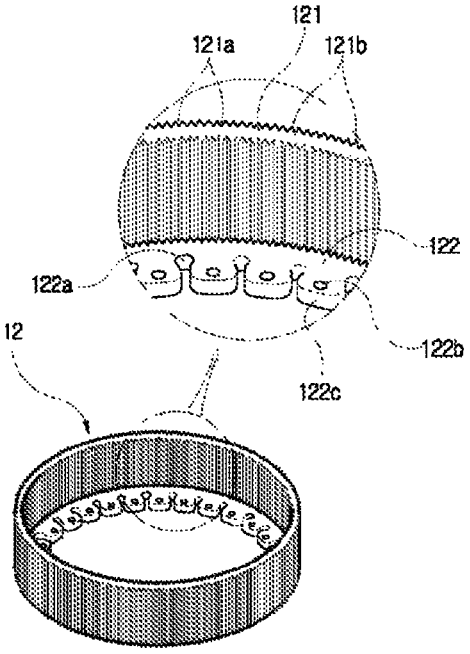
FIG. 5 is a perspective view showing another embodiment of a heat sink ring applied to the LED lighting apparatus having a multifunctional heat sink flange according to the present invention.

FIG. 1 is a perspective view showing a light-emitting diode (LED) lighting apparatus having a multifunctional heat sink flange according to the present invention. FIG. 2 is a partial cutaway front view showing the LED lighting apparatus having a multifunctional heat sink flange according to the present invention. FIG. 3 is a partial exploded perspective view showing a state in which heat sink segments are further installed on the LED lighting apparatus having a multifunctional heat sink flange according to the present invention. FIG. 4 is an exploded perspective view showing an embodiment of a heat sink ring applied to the LED lighting apparatus having a multifunctional heat sink flange according to the present invention. FIG. 5 is a perspective view showing another embodiment of a heat sink ring applied to the LED lighting apparatus having a multifunctional heat sink flange according to the present invention.

Figure 6:
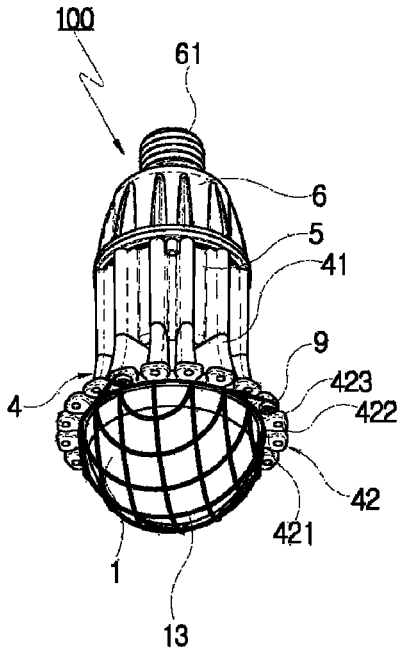
FIG. 6 is a perspective view showing a state in which a protective cage is installed on the LED lighting apparatus having a multifunctional heat sink flange according to the present invention.
Figure 7:
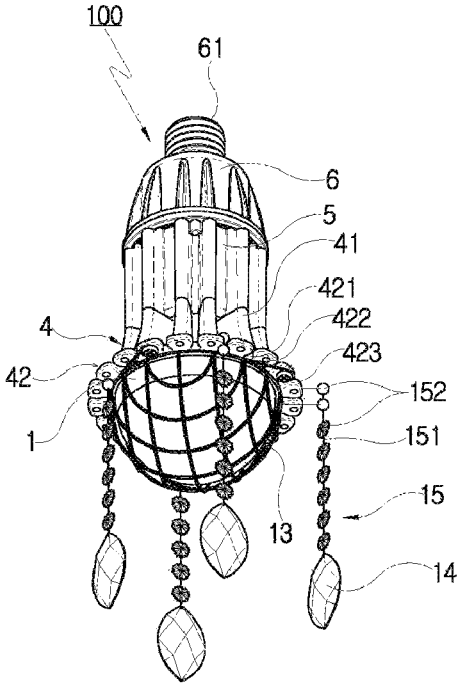
FIG. 7 is a partial exploded perspective view showing a state in which a protective cage and ornaments are installed on the LED lighting apparatus having a multifunctional heat sink flange according to the present invention.
Figure 8:
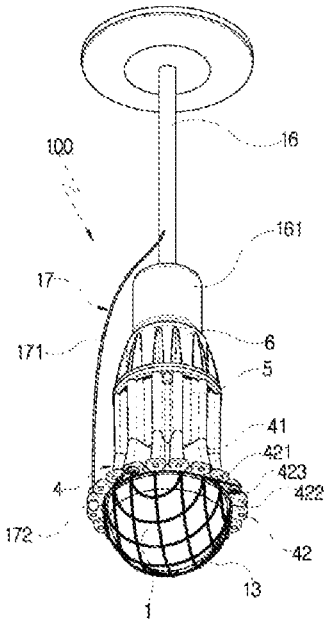
FIG. 8 is a perspective view showing a state in which an anti-dropping gadget is installed between a lighting apparatus installing rod and the LED lighting apparatus having a multifunctional heat sink flange according to the present invention.
Figure 9:
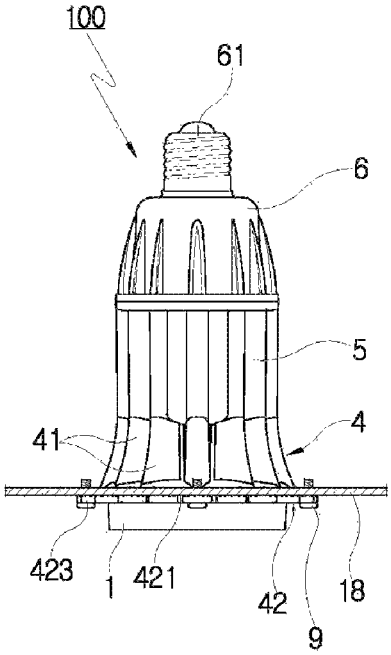
FIG. 9 is a front cross-sectional view showing a state in which the LED lighting apparatus having a multifunctional heat sink flange according to the present invention is installed on a ceiling.
Figure 10:
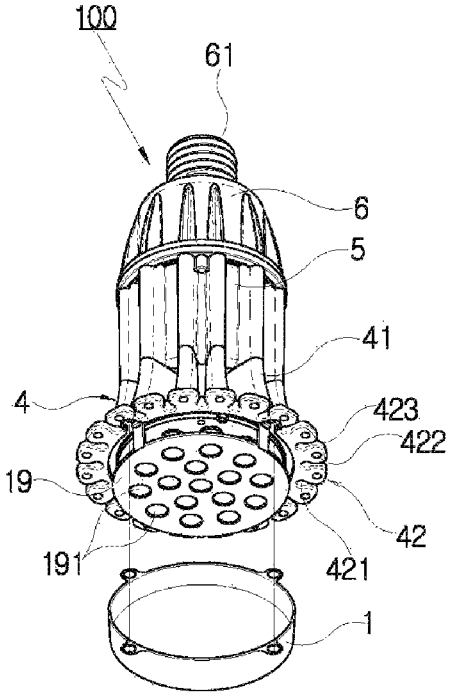
FIG. 10 is a partial exploded perspective view showing a state in which a pattern plate is installed on the LED lighting apparatus having a multifunctional heat sink flange according to the present invention.

Further, FIG. 6 is a perspective view showing a state in which a protective cage is installed on the LED lighting apparatus having a multifunctional heat sink flange according to the present invention. FIG. 7 is a partial exploded perspective view showing a state in which a protective cage and ornaments are installed on the LED lighting apparatus having a multifunctional heat sink flange according to the present invention. FIG. 8 is a perspective view showing a state in which an anti-dropping gadget is installed between a lighting apparatus installing rod and the LED lighting apparatus having a multifunctional heat sink flange according to the present invention. FIG. 9 is a front cross-sectional view showing a state in which the LED lighting apparatus having a multifunctional heat sink flange according to the present invention is installed on a ceiling. FIG. 10 is a partial exploded perspective view showing a state in which a pattern plate is installed on the LED lighting apparatus having a multifunctional heat sink flange according to the present invention.

Figure 11:
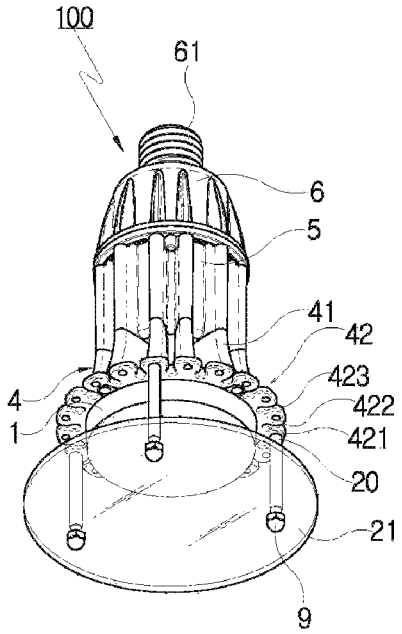
FIG. 11 is a perspective view showing a state in which a lighting color presentation plate is installed on the LED lighting apparatus having a multifunctional heat sink flange according to the present invention.
Figure 12:
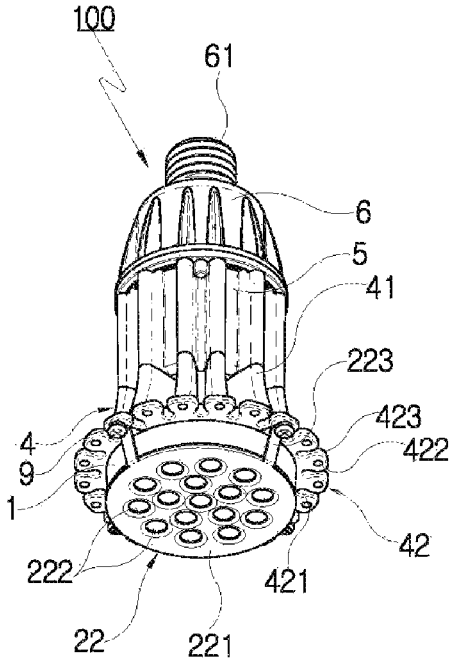
FIG. 12 is a perspective view showing a state in which a shock damage-proof plate is installed on the LED lighting apparatus having a multifunctional heat sink flange according to the present invention.
Figure 13:
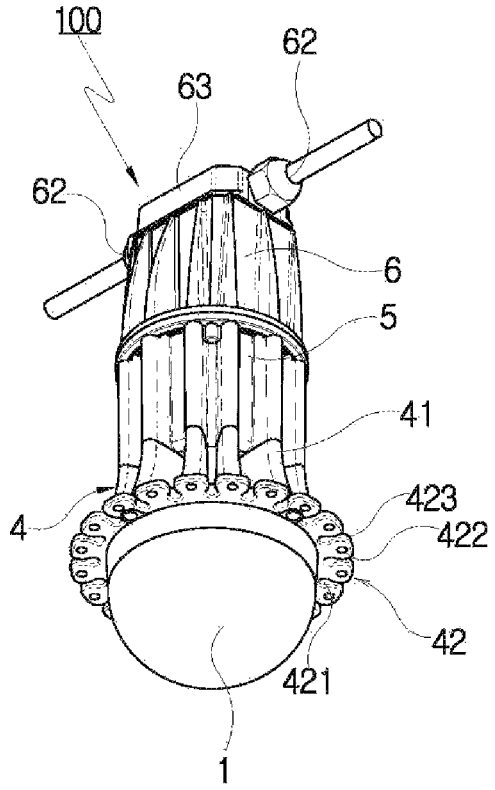
FIG. 13 is a perspective view showing a state in which a quadrangular case instead of a spiral socket coupler is installed on a head of the LED lighting apparatus having a multifunctional heat sink flange according to the present invention.
Figure 14:
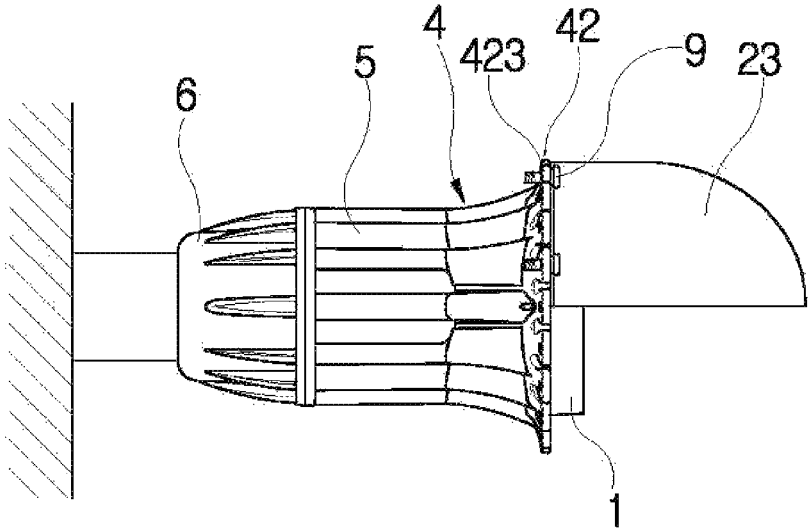
FIG. 14 is a side view showing a state in which an upward domed light collecting reflector shade is installed on a head of the LED lighting apparatus having a multifunctional heat sink flange according to the present invention.
Figure 15:
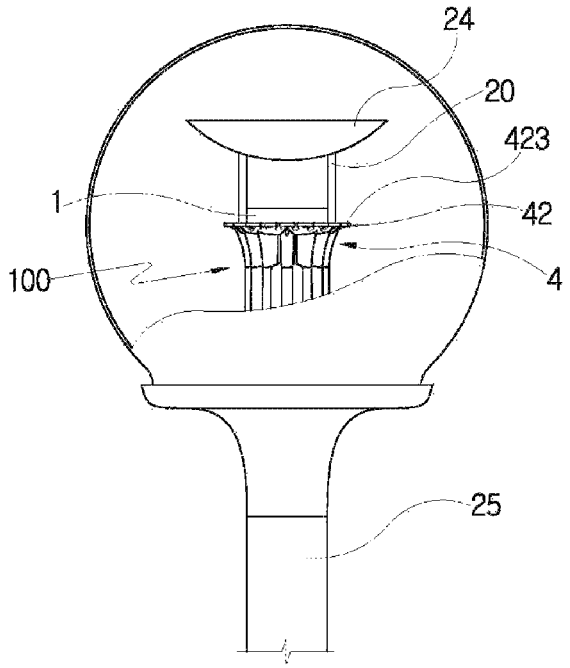
FIG. 15 is a side view showing a state in which a downward domed light diffusing reflector shade is installed on a head of the LED lighting apparatus having a multifunctional heat sink flange according to the present invention.
Figure 16:
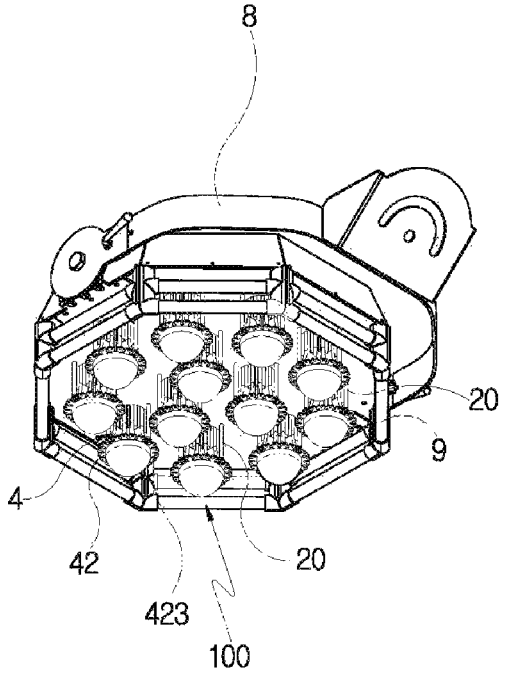
FIG. 16 is a perspective view showing a state in which the LED lighting apparatuses having a multifunctional heat sink flange according to the present invention are installed in a case of a security light or a floodlight.

In addition, FIG. 11 is a perspective view showing a state in which a lighting color presentation plate is installed on the LED lighting apparatus having a multifunctional heat sink flange according to the present invention. FIG. 12 is a perspective view showing a state in which a shock damage-proof plate is installed on the LED lighting apparatus having a multifunctional heat sink flange according to the present invention. FIG. 13 is a perspective view showing a state in which a quadrangular case instead of a spiral socket coupler is installed on a head of the LED lighting apparatus having a multifunctional heat sink flange according to the present invention. FIG. 14 is a side view showing a state in which an upward domed light collecting reflector shade is installed on a head of the LED lighting apparatus having a multifunctional heat sink flange according to the present invention. FIG. 15 is a side view showing a state in which a downward domed light diffusing reflector shade is installed on a head of the LED lighting apparatus having a multifunctional heat sink flange according to the present invention. FIG. 16 is a perspective view showing a state in which the LED lighting apparatuses having a multifunctional heat sink flange according to the present invention are installed in a case of a security light or a floodlight.

The present invention relates to an LED lighting apparatus 100, which includes an LED board 3 on which a transmitted light cap 1 and a plurality of LEDs 2 are mounted, a main heat sink 4 formed of magnesium or an magnesium alloy to dissipate heat generated from the LEDs 2, an auxiliary heat sink 5 formed of a conductive/polymeric resin material for heat dissipation, a heat sink upper case 6 formed of a conductive/polymeric resin material for heat dissipation, and a power supply 7, wherein the main heat sink 4 includes multiple heat sink protrusions 41 that are integrally formed in a longitudinal direction with a regular interval on an outer surface thereof so as to protrude radially and to increase the heat dissipation area, and a heat sink flange 42 formed along an outer circumference of a bottom thereof in such a manner that omega-shaped wings 423 having enclosed holes 422 and inverse omega-shaped open holes 421 are alternately formed. Here, the LED lighting apparatus functions as a low-powered lighting lamp when installed independently, and is used for other high-powered lighting lamps when combined and installed in a case 8 having a predetermined area and shape so as to have the desired light output.

Here, the heat sink segments 11 are formed of aluminum or copper in a rod shape in order to variably increase the heat dissipation area, are disposed on upper surfaces of some of the wings 423 of the heat sink flange 42 that are integrally formed to protrude from the bottom of the main heat sink 4 by a preset number, and are integrally fixed by riveting or bolts.

Further, a heat sink ring 12 is formed of aluminum or copper to increase the heat dissipation area, and is removably installed on an upper surface of the heat sink flange 42 that is integrally formed to protrude from the bottom of the main heat sink 4 using bolts 9. The heat sink ring 12 is configured such that a cylinder 121 having a predetermined height and diameter and a horizontal fixing plate 122 are formed in one body.

Here, the heat sink ring 12 further includes a plurality of ribs 123 for reinforcing strength and increasing the heat dissipation area. The ribs 123 are disposed on an inner surface of the cylinder 121 and on an upper surface of the horizontal fixing plate 122 at predetermined intervals.

Further, the horizontal fixing plate 122 of the heat sink ring 12 is provided with wings 122*c* having enclosed holes 122*b* and open holes 122*a*. The wings 122*c* and the open holes 122*a* are alternately formed in the opposite shape of those of the heat sink flange 42.

Also, each of the inner and outer surfaces of the cylinder 121 of the heat sink ring 12 has a plurality of vertical grooves 121*a* and ridges 121*b* that are alternately formed to further increase the heat dissipation area.

Further, a protective cage 13 is removably installed on the bottom of the heat sink flange 42 of the main heat sink 4 so as to enclose the transmitted light cap 1. The protective cage 13 is fastened to the enclosed holes 422 formed in the wings 423 of the heat sink flange 42 by the plurality of bolts 9.

Some of the inverse omega-shaped open holes 421 formed between the wings 423 of the heat sink flange 42 of the main heat sink 4 are removably coupled with ornaments 14 having a predetermined shape by ornament connecting chains 15, in each of which beads 152 are integrally fixed to a predetermined length of string 151 at fixed intervals.

Further, an anti-dropping gadget 17 in which beads 172 are integrally fixed to an end of a predetermined length of string 171 at a predetermined interval is removably installed between a lighting apparatus installing rod 16, which has a socket 161 and is fixed to a ceiling or a wall of a building so as to allow the LED lighting apparatus 100 to be coupled in an electric lamp type device, and one of the inverse omega-shaped open holes 421 of the heat sink flange 42 of the main heat sink 4.

The LED lighting apparatus 100 installed in a ceiling embedded type is fixed to a ceiling 18 by fastening the plurality of bolts 9 to the enclosed holes 422 of the wings 423 formed in the heat sink flange 42 of the main heat sink 4.

Further, an inner surface of the transmitted light cap 1 removably installed on the bottom of the main heat sink 4 is further provided with a colored pattern plate 19 in which light transmitting portions 191 are formed only on portions corresponding to the positions of the LEDs 2.

Also, upper ends of a plurality of heat sink supports 20 having a predetermined diameter and length are removably fixed to bottoms of some of the wings 423 of the heat sink flange 42 of the main heat sink 4 by the bolts 9. A lighting color presentation plate 21 formed of a colored glass or plastic is removably installed on lower ends of the heat sink supports 20 using the plurality of bolts 9.

Further, a shock damage-proof plate 22 is further removably installed under the transmitted light cap 1. The shock damage-proof plate 22 is configured such that light passing holes 222 are formed in a circular plate 221 at portions corresponding to the positions of the LEDs 2, and a plurality of fixing pieces 223 are bent on an outer circumference of the circular plate 221 at a predetermined angle and are fixed to the enclosed holes 422 of some of the wings 423 of the heat sink flange 42 of the main heat sink 4 by the bolts 9.

A quadrangular case 63 having a spiral socket coupler 61 or power cable guide holes 62 on both sides thereof is removably installed on an upper portion of the heat sink upper case 6 in which the power supply 7 is installed.

Further, when the LED lighting apparatus 100 is removably installed on the wall of a building in an electric lamp type device in a horizontal direction, a upward domed light collecting reflector shade 23 is removably coupled to the plurality of wings 423 of the heat sink flange 42 of the main heat sink 4 by the plurality of bolts 9, thereby allowing light irradiated from the LEDs 2 to be reflected in a downward direction.

Also, when the LED lighting apparatus 100 is removably installed on an upper end of a post 25 installed on a terrace, the lower ends of the heat sink supports 20, each of which has a predetermined diameter and height, are fixed to the plurality of wings 423 of the heat sink flange 42 of the main heat sink 4 by the plurality of bolts 9, and a downward domed light diffusing reflector shade 24 is removably installed on the upper ends of the heat sink supports 20 so as to allow a part of light irradiated from the LEDs 2 toward a ceiling or a sky to be reflected in a bottom direction of the terrace.

Further, when a security light, a street light, or a floodlight is manufactured by installing a plurality of LED lighting apparatuses 100 in a case 8 having a predetermined area and shape so as to provide desired light output, the upper and lower ends of the heat sink supports 20, each of which has a predetermined diameter and height, are removably installed between the upper surfaces of the plurality of wings 423 of the heat sink flange 42 of the main heat sink 4 and a ceiling surface of the case 8 using the plurality of bolts 9.

Here, the heat sink supports 20 are formed of copper or aluminum.

Operations and effects of the LED lighting apparatus having a multifunctional heat sink flange according to the present invention will be described below.

First, as shown in FIGS. 1 and 3, the LED lighting apparatus 100 includes an LED board 3 on which a transmitted light cap 1 and a plurality of LEDs 2 are mounted, and a main heat sink 4, a main heat sink 4, an auxiliary heat sink 5, a heat sink upper case 6, and a power supply 7 formed in a predetermined shape, wherein the main heat sink 4 includes a heat sink flange 42 formed along an outer circumference of a bottom thereof such that omega-shaped wings 423 having enclosed holes 422 and inverse omega-shaped open holes 421 are alternately formed. Here, the LED lighting apparatus functions as a low-powered lighting lamp when installed independently, and is used for other high-powered lighting lamps when combined and installed in a case 8 having a predetermined area and shape so as to have desired light output.

Here, among the components of the LED lighting apparatus 100, the transmitted light cap 1 is formed of a synthetic resin material having light transmission in a semisphere shape or a circular pan shape by injection molding. The transmitted light cap 1 is removably coupled to the bottom of the main heat sink 4, and functions to transmit or diffuse the light emitted from the LEDs 2 and to prevent various foreign materials and rainwater from being introduced from the outside.

The LED board 3 includes a printed circuit board formed of aluminum or epoxy resin, and is configured such that the plurality of LEDs 2 are soldered to the bottom thereof at predetermined intervals. In a state in which the LED board 3 is removably fixed to the bottom of the main heat sink 4 by a thermal conductive adhesive or screws, the LED board 3 functions to emit the light required for illumination under control of the power supply 7.

The main heat sink 4 is formed of magnesium or a magnesium alloy. The main heat sink 4 is basically formed such that the multiple heat sink protrusions 41 integrally protrude at predetermined intervals and angles in a radial direction so as to allow air to flow in all directions, and functions to dissipate most of the heat generated from the LEDs 2 to the outside.

In the present invention, the heat sink flange 42 is further formed along the outer circumference of the bottom of the main heat sink 4 having in this configuration such that the omega-shaped wings 423 having the enclosed holes 422 and the inverse omega-shaped open holes 421 are alternately formed, thereby widening the heat dissipation area of the main heat sink 4 having the same shape. As a result, the heat sink flange 42 can remarkably increase heat dissipation performance of heat generated from the power supply 7 including the LEDs 2 and light efficiency, and reduce weight, size, and production cost of the LED lighting apparatus when the LED lighting apparatus is manufactured. Particularly, the heat sink flange 42 itself is adapted to be used for various functions as described below.

Here, among the components of the heat sink flange 42, the inverse omega-shaped open holes 421 cause air to flow upward and downward, thereby increasing heat dissipation efficiency and simultaneously making it possible to easily install various structures to be described below. The wings 423 make it possible to maximally increase the heat dissipation area of the main heat sink 4 itself. Like the aforementioned open holes 421, the enclosed holes 422 formed in the wings 323 cause air to flow upward and downward, thereby increasing the heat dissipation efficiency and removably installing various structures on the wings 423 using bolts.

The auxiliary heat sink 5 is formed of a conductive/polymeric resin material for the heat dissipation by injection molding. The auxiliary heat sink 5 has heat sink protrusions 51 protrudingly formed in a longitudinal direction with a regular interval on an outer surface thereof. The auxiliary heat sink 5 is removably installed between the upper portion of the main heat sink 4 and the heat sink upper case 6 to be described below, thereby dissipating remaining heat of the LEDs 2 which is transmitted through the main heat sink 4. Wherein the heat sink protrusions of the auxiliary heat sink 5 are arranged in corresponding positions of the heat sink protrusions of the main heat sink 4.

Like the auxiliary heat sink 5, the heat sink upper case 6 is formed of a conductive/polymeric resin material for the heat dissipation by injection molding. The heat sink upper case 6 has grooves 64 formed in a longitudinal direction with a regular interval on an outer surface thereof. The heat sink upper case 6 is configured such that the spiral socket coupler 61 as shown in FIGS. 1 to 11 or the quadrangular case 63 on both sides of which the power cable guide holes 62 are provided as in FIG. 13 is removably installed on the upper portion thereof. In a state in which the heat sink upper case 6 is disposed on the upper surface of the auxiliary heat sink 5, the heat sink upper case 6 is removably coupled by screws, and performs a complex function of dissipating the remaining heat of the LEDs 2 which is transmitted through the main and auxiliary heat sinks 4 and 5 including the heat generated from the power supply 7 installed therein.

Here, the conductive/polymeric resin material used to injection-mold the auxiliary heat sink 5 and the heat sink upper case 6 includes a carbon nanotube metal polymer (CMP) containing carbon nanotubes (CNTs) having a thermal diffusion coefficient of 0.75 to 0.8 $cm^2$/sec, heat conductivity of 90 to 150 W/mK, density of 1.4±0.2 g/$cm^3$, a melting point of 105 to 160° C., specific heat of 1.1±0.4 J/gK.

When the auxiliary heat sink 5 and the heat sink upper case 6 are formed of CMP, they have a density of 1.4±0.2 g/$cm^3$ and a specific heat of 1.1±0.4 J/gK, which are lower than those of aluminum, i.e., density of 2.7 g/$cm^3$ and specific heat of 0.9 J/gK, and a thermal diffusion coefficient of 0.75 to 0.8 $cm^2$/sec, which is similar to or higher than that of aluminum, i.e., a thermal diffusion coefficient of 0.6 to 0.84 $cm^2$/sec.

The power supply 7 is housed in the heat sink upper case 6, and functions to provide supply voltage required to drive the LEDs 2.

As described above, in the present invention, it is configured as another major technical configuration that the heat sink segments 11, which are formed of aluminum or copper in a rod shape to variably increase the heat dissipation area, are disposed on upper surfaces of some of the wings 423 of the heat sink flange 42 integrally formed to protrude from the bottom of the main heat sink 4 by a preset number, and are integrally fixed by riveting or bolts as in FIG. 3.

Here, when the heat sink segments 11 are to be fixed by riveting, fixing protrusions (given no reference number) fitted through the enclosed holes 422 of the wings 423 are further formed on the bottom of the heat sink segments 11. Then, the fixing protrusions formed on the bottom of the heat sink segments 11 are fitted into the enclosed holes 422 of the wings 423, and need to be riveted. When the heat sink segments 11 are to be fixed by bolts, bolting holes (given no reference number) are formed in the bottom of the heat sink segments 11. The bolts are inserted through the enclosed holes 422 of the wings 423, and are fastened to the bolting holes of the heat sink segments 11.

Here, when the heat sink segments 11 are integrally formed with ornaments, for instance, in a ball shape at upper ends thereof rather than simply in the rod shape, they can make beautify the appearance of the LED lighting apparatus 100 according to the present invention.

Further, in the present invention, it is configured as yet another major technical configuration that the heat sink ring 12, which is formed of aluminum or copper to increase the heat dissipation area as in FIG. 4 and includes the cylinder 121 having a predetermined height and diameter and the horizontal fixing plate 122 are removably installed on the upper surface of the heat sink flange 42, which is integrally formed to protrude from the bottom of the main heat sink 4, by the bolts 9.

Here, when the heat sink ring 12 is merely made up of the cylinder 121 and the horizontal fixing plate 122, the heat sink ring 12 itself is weak in strength and has a limit in increasing the heat dissipation area. As such, if necessary, the plurality of ribs 123 for reinforcing the strength and increasing the heat dissipation area are preferably provided between the inner surface of the cylinder 121 of the heat sink ring 12 and the upper surface of the horizontal fixing plate 122 at predetermined intervals.

Further, when the horizontal fixing plate 122 of the heat sink ring 12 is formed in a washer shape, and is put on and fixed to the upper surface of the heat sink flange 42 of the main heat sink 4 by a plurality of bolts, a part of the horizontal fixing plate 122 of the heat sink ring 12 has a chance to block the open holes 421 and the enclosed holes 422 of the wings 423 of the heat sink flange 42 to hinder upward and downward flows of air.

Thus, in the present invention, if necessary, the horizontal fixing plate 122 of the heat sink ring 12 is formed in a shape opposite to that of the heat sink flange 42 in such a manner that, as in FIG. 5, the omega-shaped open holes 122*a* and the inverse omega-shaped wings 122*c* having the enclosed holes 122*b* are alternately repeated. Thereby, the problem described above can be clearly solved.

Further, the height and thickness of the cylinder 121 are determined in consideration of lighting capacity and an amount of generated heat of the entire LED lighting apparatus 100 when the heat sink ring 12 is formed. When the height and thickness of the cylinder 121 of the heat sink ring 12 are increased too much because the lighting capacity and the amount of generated heat are very high, this may exert an influence on the appearance of the LED lighting apparatus 100.

Thus, in the present invention, when the heat sink ring 12 is installed on the LED lighting apparatus 100 in which the lighting capacity and the amount of generated heat are very high, the plurality of vertical grooves 121*a* and ridges 121*b* for further increasing the heat dissipation area are alternately formed on the inner and outer surface of the cylinder 121 of the heat sink ring 12 as in FIG. 5. Thereby, the appearance of the LED lighting apparatus 100 itself can be kept beautiful, and desired heat dissipation efficiency can be obtained.

In the present invention, the heat sink segments 11 formed in various shapes such as a rod shape and the heat sink ring 12 separately formed in various shapes such as a cylindrical shape can be removably installed on the heat sink flange 42 that is integrally formed to protrude from the bottom of the main heat sink 4. As such, the amount of dissipated heat (i.e. the heat dissipation area) of the main heat sink 4 having the same shape can be arbitrarily changed in correspondence with a change in the amount of heat generated from the LEDs 2 installed on the LED board 3 in different numbers depending on different lighting capacities. Therefore, it is possible to reduce the weight and size of the product itself as well as to remarkably cut the production cost.

Meanwhile, when the LED lighting apparatus 100 according to the present invention is to be used as an explosion proof lamp, the protective cage 13 should be installed enclosing the transmitted light cap 1 in order to prevent explosion. In this case, as shown in FIG. 6, the protective cage 13 needs to be removably installed on the bottom of the heat sink flange 42 of the main heat sink 4 using the plurality of bolts 9 fastened to the enclosed holes 422 formed in the wings 423 of the heat sink flange 42.

Further, when the LED lighting apparatus 100 according to the present invention is to be used for, for instance, a living room lamp, the ornaments 14 having various patterns and shapes are required to be installed to create beauty in appearance. In this case, as shown in FIG. 7, the ornaments 14 having a predetermined shape need to be removably installed in some of the inverse omega-shaped open holes 421 formed between the wings 423 of the heat sink flange 42 of the main heat sink 4 using the ornament connecting chains 15 connected to the ornaments 14, i.e. the ornament connecting chains 15, in each of which the beads 152 are integrally fixed to the string 151 having a predetermined length at fixed intervals.

Further, when the LED lighting apparatus 100 according to the present invention is to be installed on a ceiling or a wall where it is very difficult to replace the LED lighting apparatus 100, there is a chance to miss the LED lighting apparatus 100 due to the lack of attention during the replacement, which may lead to a safety accident. In this case, the anti-dropping gadget 17 in which the beads 172 are integrally fixed to the end of the string 171 having a predetermined length at a predetermined interval needs to be removably installed between the lighting apparatus installing rod 16, which has the socket 161 and is fixed to the ceiling or the wall of a building so as to allow the LED lighting apparatus 100 to be coupled in an electric lamp type device, and one of the inverse omega-shaped open holes 421 of the heat sink flange 42 of the main heat sink 4.

Further, when the LED lighting apparatus 100 according to the present invention is to be embedded in a ceiling, the LED lighting apparatus 100 needs to be fitted into a lighting apparatus installing hole (given no reference number) drilled in the ceiling 18, and be fixed to the ceiling 18 by fastening the plurality of bolts 9 to the enclosed holes 422 of some of the wings 423, which are formed in the heat sink flange 42 of the main heat sink 4, at predetermined intervals.

In this way, when the LED lighting apparatus 100 is embedded in the ceiling, the LED lighting apparatus 100 is fixed to the ceiling 18 by fastening the plurality of bolts 9 to the enclosed holes 422 of some of the wings 423, which are formed in the heat sink flange 42 of the main heat sink 4, at predetermined intervals. In this case, the reflector shade and the fixing plate that have been used up to now are not required. As such, it is possible to remarkably reduce the production cost and installation expenses of the LED lighting apparatus 100 installed in the ceiling embedded type.

Further, when light of various colors and patterns is to be emitted from the LED lighting apparatus 100 according to the present invention, the colored pattern plate 19 in which the light transmitting portions 191 are formed only on the portions corresponding to the positions of the LEDs 2 needs to be further installed on the inner surface of the transmitted light cap 1 that is removably installed on the bottom of the main heat sink 4.

In this way, when the colored pattern plate 19 having the plurality of light transmitting portions 191 is installed on the inner surface of the transmitted light cap 1, most of the light from the LEDs 2 transmits the light transmitting portions 191, and part of the light transmits the colored pattern plate 19. As such, it is possible to create a beautiful lighting state.

Further, if necessary, in the LED lighting apparatus 100 according to the present invention, the upper ends of the plurality of heat sink supports 20 having a predetermined diameter and length as shown in FIG. 11 are removably fixed to the bottoms of some of the wings 423 of the heat sink flange 42 of the main heat sink 4 by the bolts 9, and the lighting color presentation plate 21 formed of glass of various colors or plastic of a predetermined color is removably installed on the lower ends of the heat sink supports 20 using the plurality of bolts 9. Thereby, lighting of various colors is made possible.

Meanwhile, when the LED lighting apparatus 100 according to the present invention is used for various purposes, the LED lighting apparatus 100 may be installed at a place exposed to a very poor environment in which shocks frequently occur due to various external factors. In this case, the shock damage-proof plate 22 having a predetermined shape is preferably installed under the transmitted light cap 1 as shown in FIG. 12.

Here, the shock damage-proof plate 22 may be formed in various shapes. In the present invention, the light passing holes 222 are formed in the circular plate 221 having the same diameter as the transmitted light cap 1 at the portions at which the LEDs 2 are located, and the plurality of fixing pieces 223 are integrally bent on the outer circumference of the circular plate 221 at a predetermined angle and are fixed to the enclosed holes 422 of some of the wings 423 of the heat sink flange 42 of the main heat sink 4 by the bolts 9.

Further, to allow light to be irradiated in a horizontal direction rather than a downward direction when the LED lighting apparatus 100 according to the present invention is used in an electric lamp type device, the LED lighting apparatus 100 is removably installed on the wall of the building in the electric lamp type in the horizontal direction. In this case, the LED lighting apparatus 100 is coupled to a socket installed on the wall of the building first, and then the light collecting reflector shade 23 formed to have an upward domed shape needs to be removably installed on the wings located at the upper portion among the plurality of wings 423 provided for the heat sink flange 42 of the main heat sink 4 so as to allow the light irradiated from the LEDs 2 to be directed in the downward direction using the plurality of bolts 9, as shown in FIG. 14.

Further, when the LED lighting apparatus 100 according to the present invention is to be used as a terrace lighting lamp configured to allow light to be irradiated in an upward direction and then to reflect a part of the light in the downward direction again when used in an electric lamp type device, the lower ends of the heat sink supports 20, each of which has a predetermined diameter and height, are fixed to the upper surfaces of the plurality of wings 423 of the heat sink flange 42 provided for the main heat sink 4 of the LED lighting apparatus 100 that is removably installed on the upper end of the post 25 installed on the terrace using the plurality of bolts 9, as shown in FIG. 15. Then, the light diffusing reflector shade 24 formed to have a downward domed shape is removably installed on the upper ends of the heat sink supports 20. Thereby, a part of the light irradiated from the LEDs 2 toward the ceiling or the sky can be reflected in the bottom direction of the terrace by the downward domed light diffusing reflector shade 24.

In addition, when the plurality of LED lighting apparatuses 100 according to the present invention are installed in the case 8 having a predetermined area and shape so as to be used as a security light, a street light, or a floodlight having desired light output, the LED lighting apparatuses 100, in each of which the quadrangular case 63 on both sides of which the power cable guide holes 62 are provided is installed on the heat sink upper case 6, are preferably installed in the case 8 first. When these LED lighting apparatuses 100 are installed in the case 8, the upper and lower ends of the heat sink supports 20, each of which has a predetermined diameter and height, need to be removably installed between the upper surfaces of the plurality of wings 423 of the heat sink flange 42 of the main heat sink 4 and the ceiling surface of the case 8 using the plurality of bolts 9, as shown in FIG. 16.

Here, the heat sink supports 20 formed of copper and aluminum having excellent heat dissipation effects are preferably used.

In the present invention, if necessary, various structures may be installed and used in correspondence with a place or a position at which the LED lighting apparatus is installed and a function of the LED lighting apparatus using the heat sink flange 42 integrally formed to protrude from the bottom of the main heat sink 4. As such, it is possible to remarkably improve usability and compatibility of the LED lighting apparatus 100 according to the present invention. Further, the LED lighting apparatus does not require a separate component to be installed on the various structures. As such, the cost required to produce various lighting lamps using the LED lighting apparatus can be reduced.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A light-emitting diode (LED) lighting apparatus having a multifunctional heat sink flange, comprising:

a spiral socket coupler;

a heat sink upper case removably coupled to the spiral socket coupler and having grooves formed in a longitudinal direction with a regular interval on an outer surface of the heat sink upper case;

a power supply installed inside the heat sink upper case and providing an electrical power required to drive LEDs;

an auxiliary heat sink removably coupled to the heat sink upper case and having first heat sink protrusions protrudingly formed in a longitudinal direction with a regular interval on an outer surface of the auxiliary heat sink;

a main heat sink removably coupled to the auxiliary heat sink and including second heat sink protrusions protrudingly formed in a longitudinal direction with a regular interval on an outer surface of the main heat sink, wherein the second heat sink protrusions are arranged in corresponding positions of the first heat sink protrusions of the auxiliary heat sink, and a heat sink flange integrally formed in an end of the main heat sink along an outer circumference of the main heat sink and including wings having a shape resembling a capital Greek letter omega (Ω) and extending out of the heat sink flange in a regular interval, enclosed holes, each of the enclosed holes being formed in each of the wings, and open holes formed between neighboring two wings of the wings such that the open holes have a shape resembling an upside-down capital Greek letter omega (℧);

heat sink segments formed of aluminum or copper in a rod shape and fitted into the enclosed holes of the wings; and an LED board on which a light transmitting cap and the LEDs are mounted.

2. The LED lighting apparatus according to claim 1, further comprising:

a heat sink ring removably coupled with the main heat sink and formed of aluminum or copper to increase a heat dissipation area, the heat sink ring including a cylindrical part having a predetermined height and diameter, and a horizontal fixing plate formed integrally with cylindrical part in an end of the cylindrical part.

3. The LED lighting apparatus according to claim 2, wherein the heat sink ring further includes a plurality of ribs disposed on an inner surface of the cylindrical part of the heat sink ring and on an upper surface of the horizontal fixing plate at predetermined intervals.

4. The LED lighting apparatus according to claim 1, further comprising:

an ornament removably coupled by a connecting chain to an open hole formed between the wings of the heat sink flange of the main heat sink.

5. The LED lighting apparatus according to claim 1, further comprising an anti-dropping gadget that is removably installed between a lighting apparatus installing rod and one of the open holes of the heat sink flange of the main heat sink, wherein the lighting apparatus installing rod is configured to be fixed to a ceiling or a wall of a building so as to allow the LED lighting apparatus to be coupled in an electric lamp type device.

6. The LED lighting apparatus according to claim 1, wherein the light transmitting cap further includes a colored pattern plate which is installed on an inner surface of the light transmitting cap, and the colored pattern plate has light transmitting portions formed only on portions corresponding to positions of the LEDs.

7. The LED lighting apparatus according to claim 1, further comprising:

a upward domed light collecting reflector shade removably coupled to the heat sink flange by bolts so as to allow light irradiated from the LEDs to be reflected in a lateral direction.

8. The LED lighting apparatus according to claim 1, wherein the LED lighting apparatus is configured to be removably installed on an upper end of a post, and wherein the LED lighting apparatus further comprises heat sink supports configured to be removably coupled with a downward domed light diffusing reflector shade on upper ends thereof so as to allow a part of light irradiated from the LEDs toward a ceiling or a sky to be reflected in a direction of a bottom of the post.

9. The LED lighting apparatus according to claim 8, wherein the heat sink supports are formed of copper or aluminum.

10. The LED lighting apparatus according to claim 1, wherein the main heat sink is formed of magnesium or a magnesium alloy, and the auxiliary heat sink and the heat sink upper case are formed of a conductive material or a polymeric resin material.

* * * * *